United States Patent [19]

Ichimura et al.

[11] Patent Number: 4,692,392

[45] Date of Patent: Sep. 8, 1987

[54] COLOR ELECTROPHOTOGRAPHIC PROCESS USES LAYERED PHOTOSENSITIVE ELEMENT HAVING CONDUCTIVE FILM ON SIDE PORTION

[75] Inventors: Kenichi Ichimura, Moriyama; Hiroshi Ichida, Kusatsu, both of Japan

[73] Assignee: Ishihara Sangyo Kaisha, Ltd., Osaka, Japan

[21] Appl. No.: 873,432

[22] Filed: Jun. 4, 1986

[30] Foreign Application Priority Data

Jun. 10, 1985 [JP] Japan ..... 60-125895

[51] Int. Cl.[4] ..... G03G 5/08; G03G 13/22

[52] U.S. Cl. ..... 430/46; 430/62; 430/66

[58] Field of Search ..... 430/42, 46, 62, 66

[56] References Cited

U.S. PATENT DOCUMENTS

| | | | |
|---|---|---|---|
| 3,138,458 | 6/1964 | Kimble et al. | 420/428 |
| 3,783,021 | 1/1974 | York | 427/75 |
| 4,427,754 | 1/1984 | Uchida et al. | 430/60 |
| 4,525,441 | 6/1985 | Takahata et al. | 430/46 |

FOREIGN PATENT DOCUMENTS

| | | |
|---|---|---|
| 1273325 | 7/1968 | Fed. Rep. of Germany . |
| 2517439 | 6/1983 | France . |
| 57-78548 | 5/1982 | Japan . |

*Primary Examiner*—J. David Welsh

*Attorney, Agent, or Firm*—Browdy and Neimark

[57] ABSTRACT

The present invention aims at materialization of reproduction of an image of high quality by the color electrophotography process of the EF system according to a specific procedure of effecting back surface grounding of a photosensitive material sheet comprising a photosensitive layer consisting of titanium dioxide and a specific base sheet comprising a conductive support constituted by a conductive layer laminated on a highly smooth surface and highly specific resistivity base sheet on the basis of a conductive conveyor.

16 Claims, No Drawings

COLOR ELECTROPHOTOGRAPHIC PROCESS USES LAYERED PHOTOSENSITIVE ELEMENT HAVING CONDUCTIVE FILM ON SIDE PORTION

FIELD OF THE INVENTION

The present invention relates to an electrophotography process for forming sharp multicolor image on a titanium dioxide base photosensitive material sheet using a highly smooth base sheet.

DESCRIPTION OF THE PRIOR ART

The so-called color electrofax process (hereinafter referred to as "EF process"), which is well known, is a color electrophotography imaging process comprising sequentially repeating the imaging steps of supporting a photosensitive material sheet comprising a conductive support sheet and a photosensitive layer laminated thereon and made of a photoconductive substance dispersed in an insulating resin on a conductive conveyor in the form of a drum, a belt, or the like, charging the photosensitive material sheet by corona discharge, exposing to an optical image to form an electrostatic latent image corresponding to a manuscript, and developing said image with a toner, thereby to superpose multicolor toner images.

In the above-mentioned EF process, a most common photosensitive material sheet has a constitution comprising a conductive support made of a relatively porous base paper mainly composed of a cellulose fiber and coated, impregnated, or admixed, in formation of the paper, with a conductive substance to provide electroconductivity, and having a Bekk smoothness of about 400 to 700 sec; and a photosensitive layer laminated on the conductive support and including zinc oxide as the photoconductive substance dispersed in an insulating resin. However, the above-mentioned conventional photosensitive paper using zinc oxide is not yet capable of reproducing a pictorial image of high quality comparable with a silver salt photograph.

SUMMARY OF THE INVENTION

The electrophotography process has recently been strongly motivated to reproduce a continuous tone, sharp image comparable with one reproduced by the silver salt photography process. As a result of attempts to use titanium dioxide instead of zinc oxide in the photosensitive layer of the above-mentioned zinc oxide base photosensitive paper in consideration to a high degree of whiteness and an excellent continuous tone performance of titanium dioxide as a photoconductive substance, the inventors of the present invention have found that, in order to materialize reproduction of an image of high quality by the color EP process in conformity with the photoconductivity characteristics of the titanium dioxide base photosensitive layer, (1) it is necessary to use a highly smooth base sheet, in consideration to a large influence of the surface smoothness of the base sheet, and (2) it is very important to sufficiently secure uniform reverse surface grounding properties in the thickness-wise direction (direction of the volume) of the photosensitive material sheet even when such a highly smooth base sheet is used in the conductive support. As a result of further investigations based on this finding, they have completed the present invention.

BRIEF DESCRIPTION OF THE PREFERRED EMBODIMENT

The highly smooth base sheet to be used in the present invention is desired to have a Bekk smoothness of 1,000 sec or more, preferably 2,000 sec or more, a thickness of about 80 to 130$\mu$ in general enough to be flexible, and a specific resistance of usually as high as $10^{13}$ to $10^{15}$ $\Omega$cm, enough to be small in conductivity in the direction of the volume and to prevent a conductive coating from permeating thereinto to causing a non-uniform conductivity distribution in the direction of the volume. Examples of suitable materials include resin films such as synthetic paper and Mylar film, and non-porous resin-coated paper. Lamination of the conductive layer on the above-mentioned base sheet may be done by any one of various methods. For example, a metal such as aluminum, gold, silver, or copper may be deposited by the vapor deposition method, a metallic foil of such a metal may be laminated, or a conductive composition may be applied to form a conductive support. The photosensitive layer containing titanium dioxide as the main photosensitive agent can be formed by applying on the above-mentioned conductive layer a dispersion composition comprising titanium dioxide as the main photosensitive agent and, if necessary, a sensitizing dye dispersed in a binder consisting of a single resin or a combination of resins selected from among various highly insulating resins such as acrylic, alkyd, polyester, polyurethane, amino, and vinyl resins.

In the present invention, back surface grounding of the photosensitive material sheet formed in the above-mentioned manner with a portion of the conductive carrier can be done via coated conductive film(s) formed in the thickness-wise direction of the photosensitive material sheet, namely on one or both side end surfaces thereof, and at least in part of the back surface thereof. Formation of the above-mentioned conductive film(s) on the photosensitive material sheet can be done by applying a conductive composition to the predetermined portions of the sheet according to any one of various coating methods such as spraying, roller coating, silk screen printing, and brush coating methods. In any method, the application may be performed continuously or intermittently in the carrying (length-wise) direction of the photosensitive material sheet and on one or both side end surfaces in the thickness-wise direction of the photosensitive material sheet, as well as at least in part or on the whole of the back surface thereof to form a film(s) having a thickness of 3 to 7$\mu$ and a surface resistance of about $10^8$ $\Omega$ or less, preferably $10^5$ $\Omega$ or less. In the application, it is important to avoid formation of any film of the conductive composition on the obverse surface of the photosensitive material sheet. When a coating of the conductive composition adheres to the peripheral portion of the photosensitive material sheet, image formation is obstructed in that portion to provide an image having a very unclear peripheral portion. Above all, this condition is very detrimental to the quality of finish for a pictorial multicolor image, unlike line copy. Although various methods can be employed in selectively forming a uniform film(s) by applying the conductive composition to the side end surface(s) and the back surface of the photosensitive material sheet while substantially avoiding adhesion of the conductive composition to the obverse surface of the photosensitive material sheet as described above, the application may be effected with, for example, an airless type spray apparatus so arranged as to make a photosensitive material sheet of, for example, a continuous roll type run at a given rate and form a fan-like liquid film stream(s) having a small width in the running direction of the sheet and flowing toward a region(s) lying in the thickness-wise direction and in part or on the whole of the back surface of the sheet. Alternatively, the application may be effected by a silk screen printing or brush coating method so adapted to forming a conductive film(s) on the whole surface of a wound side end surface(s) (the portion of a photosensitive material sheet in the thickness-wise direction) of a roll of a continuous photosensitive material sheet and at least part of the back surface of the photosensitive material sheet.

Examples of the conductive composition to be used in forming the coated conductive film(s) for back surface grounding of the photosensitive material sheet with the conductive carrier include a combination of a conductivity-imparting substance and a water-soluble polymer binder, a combination of a conductivity-imparting substance and a curing resin binder, and a combination of a conductivity-imparting substance, a soap-free emulsion, and a water-soluble polymer binder, which may be employed either singly or in combination. Examples of the above-mentioned conductivity-imparting substance include inorganic salts such as chlorides and sulfates; organic moisture-absorptive substances such as glycerin and ethylene glycol; cation, anion, and ampholytic polymer electrolytes such as polyvinyl-benzyltrimethylammonium fluoride and sodium polystyrene-sulfonate; carbon blacks such as carbon fiber; metallic powders such as gold, silver, and copper powders; conductive metallic oxides such as metallic oxides surface-doped with a different element such as indium or cadmium; titanium dioxide particles surface-treated with tin oxide or antimony oxide; titanium oxide with a low level of oxidation; and conductive metallic halides such as copper iodide, which may be used either alone or in combination. Examples of the water-soluble polymer binder include cellulose derivatives such as methylcellulose and hydroxyethylcellulose; starch derivatives such as esterified starch and oxidized starch; natural animal and vegetable resins such as sodium alginate, casein, and gum arabic; polymer and copolymers of an acrylate and/or a maleate; and synthetic polymers such as polyvinyl alcohol, polyacrylamide, polyethyleneimine, amino resins, and water-soluble polyethylenes, which may be used either alone or in combination. If necessary, a polymer or copolymer emulsion, a cross-linking agent, an inorganic or organic pigment, etc. may be incorporated within a range where the conductivity is not adversely affected. Examples of the curing resin binder include alkyd resins, reactive acrylic resins, phenolic resins, polyurethane resins, polyamide resins, polyester resins, petroleum resins, and cross-linking vinyl monomers. They may have their respective catalysts incorporated thereinto for adapting them to their respective curing mechanisms, or may be subjected to a treatment such as heating, ultraviolet ray irradiation, or electron beam irradiation. If necessary, a pigment such as clay may be incorporated. Among conductivity-imparting substances, the above-mentioned titanium dioxide particles surface-treated with tin oxide or antimony oxide not only have a sufficiently high level of whiteness enough to avoid coloring of the photosensitive material sheet, but also are of the so-called electron conduction type, advantages, including a high stability of conductivity against the ambient humidity.

According to the present invention, a sharp multicolor image with excellent continuous tones can be formed by superposing a plurality of color toners such as yellow, magenta, and cyan toners, and, if necessary, a black toner, by a predetermined number of times of sequential repetition of the foregoing procedure of imaging step comprising supporting of a photosensitive material sheet containing titanium dioxide as the main photosensitive agent and subjected to a treatment for back surface grounding on a conductive carrier, electrification, exposure to light, and wet development with a color toner complementary to the color in color separation exposure.

The following Examples will further illustrate the present invention.

EXAMPLE 1

Aluminum was deposited by the vapor deposition method on the surface of a synthetic paper (Upo FPG mainly consisting of polypropylene and manufactured by Oji Yuka Co., Ltd.; Bekk smoothness; 2,050 sec, thickness: 130μ, width: 297 mm, length: 100 m) serving as the base sheet of a photosensitive material sheet comprising titanium dioxide as the main photosensitive agent to form a conductive layer. A coating containing a photosensitive titanium dioxide material panchromatically sensitized and dispersed in an acrylic resin binder (Arroset manufactured by Nisshoku Arrow Co., Ltd.) was applied on the conductive base sheet by the reverse coating method to form a photosensitive layer (dry thickness: 15μ). Subsequently, a coating of a conductive film composition (PVC: 50%, viscosity with a Ford Cup #4:13 sec) prepared by dispersion (weight ratio 1:1) of a conductive titanium oxide powder (titanium dioxide particles surface-treated with tin oxide and having a specific resistance of pressed powder of 2.7 Ωcm) in an acrylic resin (Elecond manufactured by Soken Kagaku Co., Ltd.) was applied to the electrophotographic photosensitive material sheet on the side end portions thereof (in the thickness-wise direction of the photosensitive material sheet) by using an airless spray apparatus (a product of Nordson) according to the following procedure. The coating was ejected (at a rate of 50 cc/min) from the spray nozzle of the above-mentioned apparatus, which was set in the rear portion on the reverse surface side of the photosensitive material sheet at an angle of 75° with the surface of the support of the photosensitive material sheet so that the coating could be spread in the form of a fan-like liquid film stream over a side end region (in the thickness-wise direction of the photosensitive material sheet) extending from the side edge portion on one side of the back surface (on the side of the support) of the photosensitive material sheet to the conductive layer. The ejection was effected by making the photosensitive material sheet run at a rate of 50 m/min, while operating an exhaust hood provided in order to substantially avoid adhesion of any excess ejected coating to the obverse surface of the photosensitive material sheet.

Without any substantial coated conductive film formed on the obverse surface of the electrophotographic photosensitive material sheet using titanium oxide as the main photoconductive substance and subjected to a treatment for reverse surface grounding, a continuous conductive film having a thickness of about 4μ was formed over a whole side end surface of the sheet and an about 3 mm edge portion of the reverse surface of the support. The surface resistance of the side end connection portion was $10^4$ Ω. The following ratings were obtained as regards the electrophotography and image characteristics of the photosensitive material sheet.

(1) Electrophotography Characteristics

The sheet was excellent in the electrification characteristic, dark retention, and photosensitivity, and had such grounding characteristics as to enhance the electrostatic latent image forming capacity of the photosensitive material.

(a) Electrification characteristic

The surface potential after 20 sec (initial potential) in electrification with corona (−6 kV) was 1,000 V.

(b) Dark retention

The surface potential 20 sec after reaching the initial potential value as mentioned in (a) above was 75% as expressed in terms of percentage relative to the initial potential.

(c) Photosensitivity

The time necessary for allowing the surface potential to decrease to half of a pre-exposure potential of 200 V at which irradiation with a light of 25 luxes was started was 0.5 sec.

(2) Image Characteristics

A multicolor image was formed on the electrophotographic photosensitive material sheet obtained in this Example and having the electrophotography characteristics as mentioned in (1) above by using a Macbeth color patch according to a customary procedure of electrification, exposure to light, development with wet developers for yellow, magenta, cyan colors to superpose toners. The color densities of the toners were 0.90 for the yellow color, 1.23 for the magenta color, and 1.35 for the cyan color as desired.

A corona discharge voltage of −6 kV was applied to the above-mentioned electrophotographic photosensitive material sheet supported on a drum-shaped conductive conveyor to uniformly negatively electrify the surface of the photosensitive layer. Subsequently, color separation exposure to light was performed with a multicolor original via a blue filter to form an electrostatic latent image corresponding to the original. Thereafter, development was effected with a wet developer of positively electrified yellow toner to finish the first imaging step. Sequentially, the second imaging step was performed with a green filter for light exposure and a magenta toner, followed by the third imaging step using a red filter for light exposure and a cyan toner. Thus, a multicolor image was formed. The obtained image had neither imaging noise such as fogging, nor nonuniformity in shade even in the peripheral portion of the photosensitive material sheet. It was dense and good in gradation. It was comparable with a silver halide photograph corresponding to the original.

In film formation from the coating with the above-mentioned airless spray apparatus, when ejection was performed in a direction substantially horizontal to the surface of the support, coated conductive film formation was observed not only in the side end portion of the photosensitive material sheet but also in a side edge portion of the obverse surface of the photosensitive layer. This resulted in insufficient image formation in the peripheral portion of the sheet, and hence appearance of nonuniformity in the shade.

EXAMPLE 2

A coating of a conductive film composition (FC-404 manufactured by Fujikura Kasei Co., Ltd.) including a carbon black powder dispersed as the conductivity-imparting substance in a polyester resin was applied to a roll of a photosensitive material sheet comprising a conductive base sheet using as the base paper a synthetic paper as used in Example 1 and a photosensitive layer formed thereon and containing titanium dioxide as the main photoconductive substance on both whole wound side end surfaces thereof and in part of the back surface thereof by using a silk screen printing machine (a product of Newlong Seimitsu Kogyo Co., Ltd., 180-mesh screen) to form coated conductive films.

The formed electrophotographic photosensitive material sheet subjected to the treatment for back surface grounding and comprising titanium dioxide as the main photosensitive agent had no substantial coated conductive film formed on the obverse surface thereof, but coated conductive films having a thickness of about 5μ on the whole regions of the side end surfaces of the sheet and an about 0.5 mm edge portion of the back surface of the support. The surface resistance of the side end connection portion was $10^2$ Ω. The electrophotography and image characteristics of the photosensitive material sheet were as good as those in Example 1.

EXAMPLE 3

A coating of a conductive film composition (XC-32 manufactured by Fujikura Kasei Co., Ltd.) including a carbon black powder dispersed in an aliphatic petroleum resin was applied to a roll of a continuous photosensitive material sheet as used in Example 2 on both whole wound side end surfaces thereof and in part of the back surface thereof according to the brush coating method to form coated conductive films.

The formed electrophotographic photosensitive material sheet subjected to the treatment for back surface connection and comprising titanium dioxide as the main photosconductive substance had no substantial coated conductive film formed on the obverse surface thereof, but coated conductive films having a thickness of about 5μ on the whole regions of the side end surfaces of the sheet and an about 0.5 mm edge portion of the back surface of the support. The surface resistance of the side end connection portion was $10^2$ Ω. The electrophotography and image characteristics of the photosensitive material sheet were as good as those in Example 1.

According to the present invention, there are provided the following excellent effects: (1) the influence of the surface smoothness of a photosensitive material sheet on the imaging noise and the like can be substantially eliminated; (2) due to the above-mentioned effect, the photoconductivity characteristics of a titanium dioxide base photosensitive layer can be sufficiently utilized and hence formation of a pictorial reproduced image of high quality comparable with a silver salt photograph is enabled; and (3) not only there is no particular necessity for providing any grounding apparatus, unlike surface grounding, but also there is no necessity for trimming the peripheral connection portion of the photosensitive material sheet, since clear can be formed over the entire surface of the sheet.

What is claimed is:

1. In a color electrophotography process comprising sequentially repeating the imaging steps of supporting photosensitive material sheet on a conductive conveyor, charging said photosensitive material sheet, exposing said charged photosensitive material sheet to an optical image to form an electrostatic latent image, and developing said latent image with a liquid developer to produce a toner image, thereby to superpose multicolor toner images, the improvement wherein said photosensitive material sheet comprises:

a base sheet having an extremely smooth surface and high specific resistivity;

a conductive layer on one face of said base sheet;

a photosensitive coating including titanium dioxide dispersed in an insulating resin on said conductive layer;

a conductive film on at least a side edge portion of said photosensitive material sheet and on at least a part of the face of said base sheet opposite said one face, said one face being essentially free of said conductive film, whereby said photosensitive material sheet is grounded, through said conductive layer, to said conductive conveyor.

2. A color electrophotography process as claimed in claim 1, wherein said base sheet has a Bekk smoothness of 1,000 sec or more and a specific resistance of $10^{13}$ to $10^{15}$ Ωcm.

3. A color electrophotography process as claimed in claim 1, wherein said base sheet has a Bekk smoothness of 2,000 sec or more and a specific resistance of $10^{13}$ to $10^{15}$ Ωcm.

4. A color electrophotography process as claimed in claim 1, wherein said base sheet is a synthetic paper.

5. A color electrophotography process as claimed in claim 1, wherein said base sheet is a resin film.

6. A color electrophotography process as claimed in claim 1, wherein said base sheet is a resin-coated paper.

7. A color electrophotography process as claimed in claim 1, wherein the thickness of said coated conductive film(s) is 3 to 7μ.

8. A color electrophotography process as claimed in claim 1, wherein the surface resistance of said coated conductive film(s) is $10^8$ Ω or less.

9. A color electrophotography process as claimed in claim 1, wherein the surface resistance of said coated conductive film(s) is $10^5$ Ω or less.

10. A color electrophotography process as claimed in claim 1, wherein said coated conductive film(s) is formed continuously or intermittently in the carrying direction (length-wise direction) of said photosensitive material sheet on one or both side end surfaces in the thickness-wise direction of said photosensitive material sheet and at least in part or on the whole of the back surface of said photosensitive material sheet.

11. A color electrophotography process as claimed in claim 1 or 10, wherein said coated conductive film(s) is formed continuously in the carrying direction (length-wise direction) of said photosensitive material sheet on one side end surface in the thickness-wise direction of said photosensitive material sheet and in at least part of the back surface of said photosensitive material sheet.

12. A color electrophotography process as claimed in claim 1 or 10, wherein said coated conductive film(s) is formed continuously in the carrying direction (length-wise direction) of said photosensitive material sheet on both side end surfaces in the thickness-wise direction of said photosensitive material sheet and in at least part of the back surface of said photosensitive material sheet.

13. A color electrophotography process as claimed in claim 1, wherein said coated conductive film(s) is formed from a conductive composition comprising a conductivity-imparting substance and a curing resin binder.

14. A color electrophotography process as claimed in claim 1 or 13, wherein said conductivity-imparting substance is surface-treated titanium oxide or carbon black, and said curing resin binder is an acrylic, petroleum, or polyester resin.

15. A color electrophotography process as claimed in claim 1, wherein said coated conductive film(s) is formed by a spraying, roller coating, silk screen printing, or brush coating method.

16. A photosensitive material sheet for use in color electrophotography, said photosensitive material sheet comprising:

a base sheet having an extremely smooth surface and high specific resistivity;

a conductive layer on one face of said base sheet;

a photosensitive coating including titanium dioxide dispersed in an insulating resin on said conductive layer;

a conductive film on at least a side edge portion of said photosensitive material sheet and on at least a part of the face of said base sheet opposite said one face, said one face being essentially free of said conductive film.

* * * * *